US005615836A

United States Patent [19]

Graef

[11] Patent Number: 5,615,836

[45] Date of Patent: Apr. 1, 1997

[54] INJECTOR NOZZLE

[76] Inventor: Jordt-Steffen Graef, Koferinger Str. 5, 93083 Obertraubling, Germany

[21] Appl. No.: 329,528

[22] Filed: Oct. 26, 1994

[30] Foreign Application Priority Data

Nov. 11, 1993 [DE] Germany ..... 43 38 585.0

[51] Int. Cl.[6] ..... E03C 1/08

[52] U.S. Cl. ..... 239/428.5; 239/432; 239/462

[58] Field of Search ..... 239/428.5, 427, 239/432, 433, 434, 462, 553, 553.3, 553.5, 590, 590.3, 590.5

[56] References Cited

U.S. PATENT DOCUMENTS

| | | | |
|---|---|---|---|
| 3,322,352 | 5/1967 | Alcantara | 239/428.5 |
| 3,865,314 | 2/1975 | Levey et al. | 239/590.3 |
| 3,946,947 | 3/1976 | Schneider | 239/428.5 |
| 4,082,225 | 4/1978 | Haynes | 239/428.5 |
| 4,221,337 | 9/1980 | Shames et al. | 239/428.5 |
| 4,330,086 | 5/1982 | Nysted | 239/432 |
| 4,646,973 | 3/1987 | Focaracci | 239/432 |
| 4,899,937 | 2/1990 | Haruch | 239/432 |
| 4,925,109 | 5/1990 | Flanagan et al. | 239/432 |
| 5,014,372 | 5/1991 | Thrasher et al. | 239/428.5 |
| 5,129,583 | 7/1992 | Bailey et al. | 239/433 |
| 5,226,601 | 7/1993 | Hinjosa, Jr. et al. | 239/428.5 |
| 5,381,957 | 1/1995 | Bianco | 239/428.5 |
| 5,431,342 | 7/1995 | Saripalli et al. | 239/590.3 |

*Primary Examiner*—Andres Kashnikow
*Assistant Examiner*—Lisa Ann Douglas
*Attorney, Agent, or Firm*—Learman & McCulloch

[57] ABSTRACT

An injector nozzle construction for producing air-filled drops of liquid includes a dosaging nozzle element coupled at its outlet to a mixing chamber provided with an air intake opening for producing a liquid/air mixture which in turn communicates with an outlet element for discharging the mixture. A particularly great uniformity and largely fluctuation-free distribution characteristic of the drops of fluid is achieved by providing between the mixing chamber and the outlet element a homogenizing and stabilizing chamber having an inlet that is substantially greater in cross-sectional size than the outlet of the mixing chamber.

19 Claims, 5 Drawing Sheets

INJECTOR NOZZLE

The invention relates to an injector nozzle for producing air-filled drops of liquid.

BACKGROUND OF THE INVENTION

So-called two-substance nozzles are already known in various constructions. A liquid and a gaseous medium are for example delivered under pressure to these nozzles, and these media are mixed with one another inside a mixing chamber. When such nozzles are used to discharge plant protectives, additional air is generally used only in order to increase the speed of the particles or droplets or to refine the drop spectrum, i.e. in order to reduce the mean drop diameter. Due to a relatively high consumption of additional air and due to the necessity of a pressure generator such nozzle systems are technically relatively costly and not very practical. In addition, the air pressure influences the quantity of liquid sprayed out, so that the technical expenditure is further increased by arrangements for regulating the quantity or keeping the quantity constant.

For discharging plant protectives injector nozzles with automatic air intake are also known, above all in the case of small hand-operated devices. The advantage of such injector nozzles lies in the unproblematic flow regulation by way of the fluid pressure, in a reduced susceptibility to wind—with regard to the discharge of plant protectives—due to a greatly increased drop diameter, and in an improvement of the coating structure on the target area, since when the air-filled drops strike for example the plant surfaces they burst, so that larger wetting surfaces are achieved with the same volume of liquid. Due to the expansion of the compressed air or gas particles when leaving the nozzle, the drops undergo an additional acceleration, which allows an improved penetration of the target stocks. However, an inhomogeneity of the liquid/air mixture before the nozzle outlet orifice has proved a disadvantage. It results in strong pulsations in the delivery of the liquid so that extremely varied drop sizes and strong fluctuations in the distribution characteristic and in the discharge of the liquid/air mixture occur in the micro range at the nozzle outlet orifice.

The object of the invention, therefore, is to create an injector nozzle that retains the previously described advantages of the known constructions and has a relatively simple design, distinguished by a particularly high uniformity of the drop sizes and a distribution characteristic of these liquid drops which is largely free of fluctuations.

SUMMARY OF THE INVENTION

In the injector nozzle according to the invention, between the mixing chamber and the outlet element there is provided a homogenizing and stabilizing chamber, the inlet cross-section of which is greatly increased in size relative to the outlet cross-section of the mixing chamber. By this means the liquid/air mixture formed in the mixing chamber and emerging therefrom is stabilized in an immediately adjoining chamber in the flow direction and is particularly favorably homogenized. This homogenizing and stabilizing chamber can be constructed approximately as a hollow space like an air vessel and acts to some extent as a pulsation damper or pressure reservoir, so that the undesirable fluctuations such as occur in the known constructions described above can be largely and generally even completely avoided, and this also applies for so-called micropulsations. By a sensible design of this homogenizing and stabilizing chamber a particularly high uniformity in the size of the liquid drops is achieved with a distribution characteristic substantially free of fluctuations. The air-filled liquid drops coming out of the outlet orifice of the outlet element of this injector nozzle are very much less susceptible to wind and thus ensure an optimum coating structure of the discharged liquid on a target area, for example when it is a question of discharging and distributing plant protectives.

It is particularly advantageous if in the injector nozzle according to the invention the inlet cross-section of the homogenizing and stabilizing chamber is approximately 1.5 to 9 times, preferably 3 to 5 times the outlet cross-section of the mixing chamber.

In this construction according to the invention the hollow space forming the homogenizing and stabilizing chamber can have approximately the volume of the mixing chamber, and in this case the shapes and constructions of this space can be specially adapted in an extremely favorable way to different purposes. Accordingly the homogenizing and stabilizing chamber can have an overall length which is greater than the length of the mixing chamber.

It can also be particularly advantageous if the homogenizing and stabilizing chamber has a rear region which forms annular space enclosing the component which forms the mixing chamber. In this construction of the said chamber the liquid/air mixture streaming out of the mixing chamber expands to some extent against the general direction of flow—backwards—which has a particularly favorable effect for avoiding micropulsations.

If required, the uniformity of the size of the drops liquid can also be improved in an advantageous manner in that between the mixing chamber and the outlet element there is provided a perforated element preferably formed by a wire mesh or a punched plate.

It may also be advantageous if the air intake opening of the mixing chamber can be connected to an arrangement, preferably a throttle device, for altering the quantity of air drawn in. In this way the drop outlet speed and the size of the drops can be influenced if required.

Furthermore, the air intake opening of the mixing chamber can also be connected to an air system which is under positive pressure, for example the exhaust system of a carrier vehicle. The can be the case for example if the injector nozzle belongs to a spraying installation with which the plant protective is to be discharged and which is borne by a motor vehicle with an internal combustion engine.

In many applications, in order to feed further liquid and/or gases into the mixing chamber it may also be advantageous to provide at least one further intake opening which could for example be constructed and and mounted in a similar manner to the air intake opening of the mixing chamber.

BRIEF DESCRIPTION OF THE DRAWINGS

This invention is described in greater detail below with the aid of some embodiments which are illustrated in the drawings, in which.

DETAILED DESCRIPTION

Figure 1:
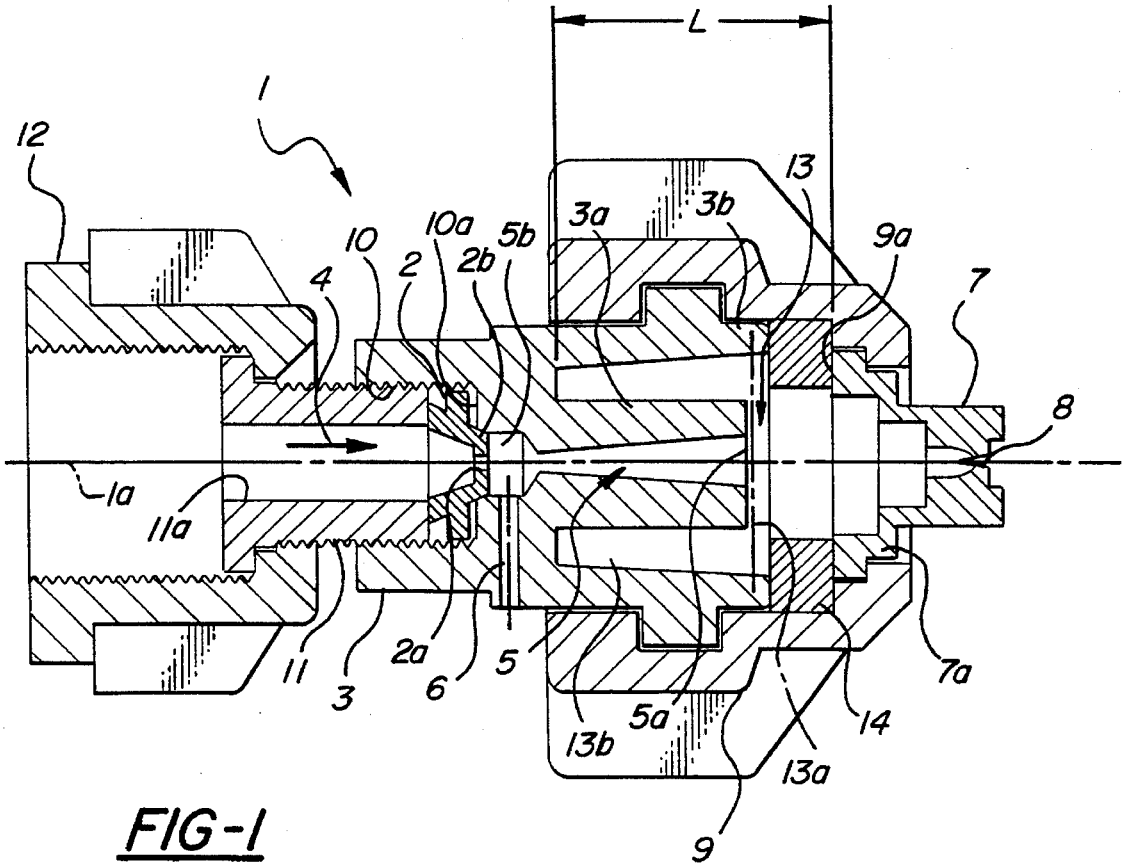
FIG. 1 shows an axial longitudinal section through a first embodiment of the injector nozzle according to the invention.

The overall design of the injector nozzle according to the invention will be explained first of all with the aid of the first embodiment illustrated in FIGS. 1 and 2. This injector nozzle 1 is constructed so as to produce air-filled drops of liquid and comprises as its principal components a dosaging nozzle element 2 for producing a jet of fluid, a central nozzle body 3 with a mixing chamber 5 which is constructed centrally therein and follows the dosaging nozzle element 2 in the flow direction (arrow 4) of the jet of fluid, is provided with an air intake opening 6 and serves to produce a fluid/air mixture, as well as an outlet element constructed in the form of a distributor mouthpiece 7 which is provided with at least one outlet opening 8 for the fluid/air mixture. This outlet element or distributor mouthpiece 7 is provided so as to be replaceable, and is fixed on the nozzle body 3 with the aid of a rapid closure system which can preferably be a bayonet closure 9.

Figure 2:
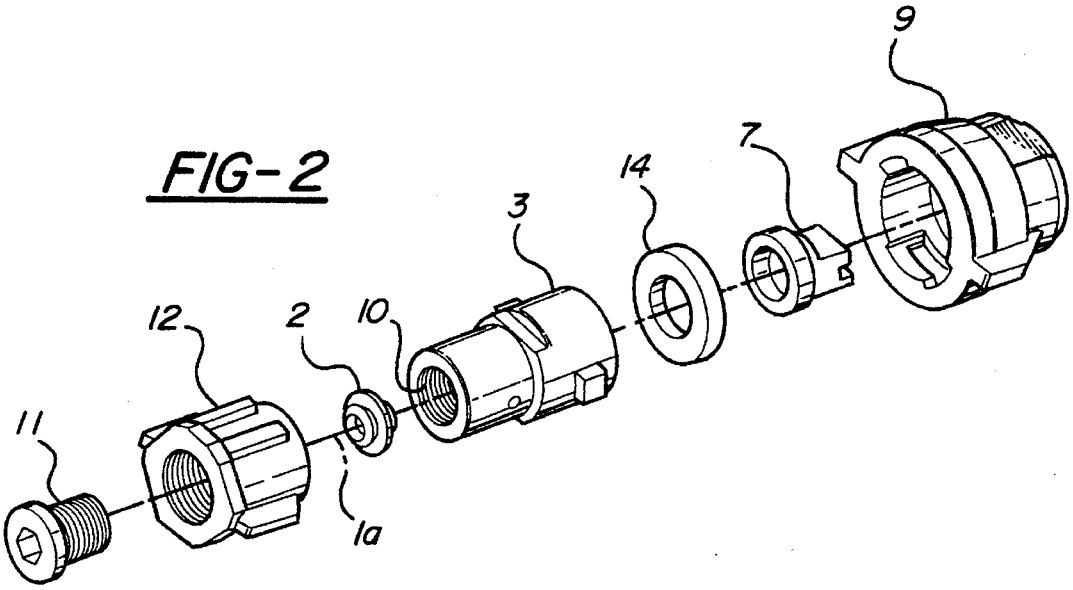
FIG. 2 shows an exploded perspective view of this injector nozzle according to the invention.

In the embodiment illustrated in FIGS. 1 and 2 the end of the nozzle body 3 facing away from the distributor mouthpiece 7 is provided with a central axial threaded bore 10 which is open towards the exterior with the dosaging nozzle element 2 loosely supported on the base 10 thereof in such a way that the nozzle orifice thereof is aligned coaxially with the central longitudinal axis la of the nozzle and the immediately adjoining mixing chamber 5. Thus this dosaging nozzle element 2 is replaceably received in the threaded bore 10 and fixed by a stopper-like threaded adapter 11 which is provided with an external thread, has a through bore 11*a* aligned coaxially with the longitudinal axis la of the nozzle and is provided on its end opposite the dosaging nozzle element 2 with a connecting nut 12 by means of which the entire injector nozzle 1 can be connected to a corresponding pipe (pipe system)—not shown here—through which a liquid to be distributed can be delivered under pressure.

As FIG. 1 also shows, there is a hollow space between the mixing chamber 5 and the distributor mouthpiece 7 which forms a homogenizing and stabilizing chamber 13, the inlet cross-section of which (indicated approximately by the dash-dot line 13*a*) is greatly enlarged relative to the outlet cross-section 5*a* of the mixing chamber 5. This inlet cross-section 13*a* of the homogenizing and stabilizing chamber 13 is approximately 1.5 to 9 times, preferably 3 to 5 times the size of the outlet cross-section 5*a* of the mixing chamber 5.

As has already been mentioned above, the homogenizing and stabilizing chamber 13 can be constructed in different ways according to the particular requirements for use of the injector nozzle 1.

In FIG. 1 it can be seen that the homogenizing and stabilizing chamber 13 can have an overall length L which is greater than the length of the mixing chamber 5. In this case the homogenizing and stabilizing chamber 13 has a rear region 13*b* which in annular form surrounds the component 3*a* of the nozzle body 3 forming the mixing chamber 5. In this case it is also favorable if an annular sealing member 14 which is made from suitable sealing or buffer material and of which the internal space also constitutes a part of the homogenizing and stabilizing chamber 13 is disposed between on the one hand the end 3*b* of the nozzle body 3 pointing in the flow direction (arrow 4) and on the other hand the inner end 7*a* of the distributor mouthpiece 7 or a corresponding shoulder 9*a* within the bayonet closure 9.

In the embodiment illustrated in FIG. 1 the mixing chamber 5 extending coaxially with respect to the longitudinal axis 1*a* of the nozzle is so constructed that it widens conically towards the homogenizing and stabilizing chamber 13, so that overall a construction is produced in the manner of the Venturi system which is known per se. In this case the air intake opening 6 can be constructed approximately in the form of a radial bore and—viewed in the flow direction (arrow 4) of the jet of liquid—can open into the rear, approximately cylindrically widened end 5*b* of the mixing chamber 5.

The replaceable dosaging nozzle element 2 can also be constructed in different ways. According to the embodiment in FIG. 1 it may be assumed that it is constructed so as to be self-centering. For this purpose the front end 2*b* of this dosaging nozzle element 2 which contains the nozzle orifice 2*a* can be constructed approximately conically and can partially engage in the approximately cylindrical rear end 5*b* of the mixing chamber 5.

In so far as the construction of the distributor mouthpiece 7 is concerned, the outlet orifice 8 provided therein can have any construction suitable for the particular purpose for which the injector nozzle 1 is to be used, in order to give the emerging liquid/air mixture for example the form of a flat jet, full cone, cone or the like.

With the aid of the representations in FIGS. 3 to 7 some further embodiments and variants of the injector nozzle according to the invention will be explained, and in fact these constructions relate particularly but not exclusively to the region of the homogenizing and stabilizing chamber, whilst all other components of the injector nozzle—in so far as they are not especially addressed—can be constructed in substantially the same way as has been explained above with the aid of FIGS. 1 and 2.

Figure 3:
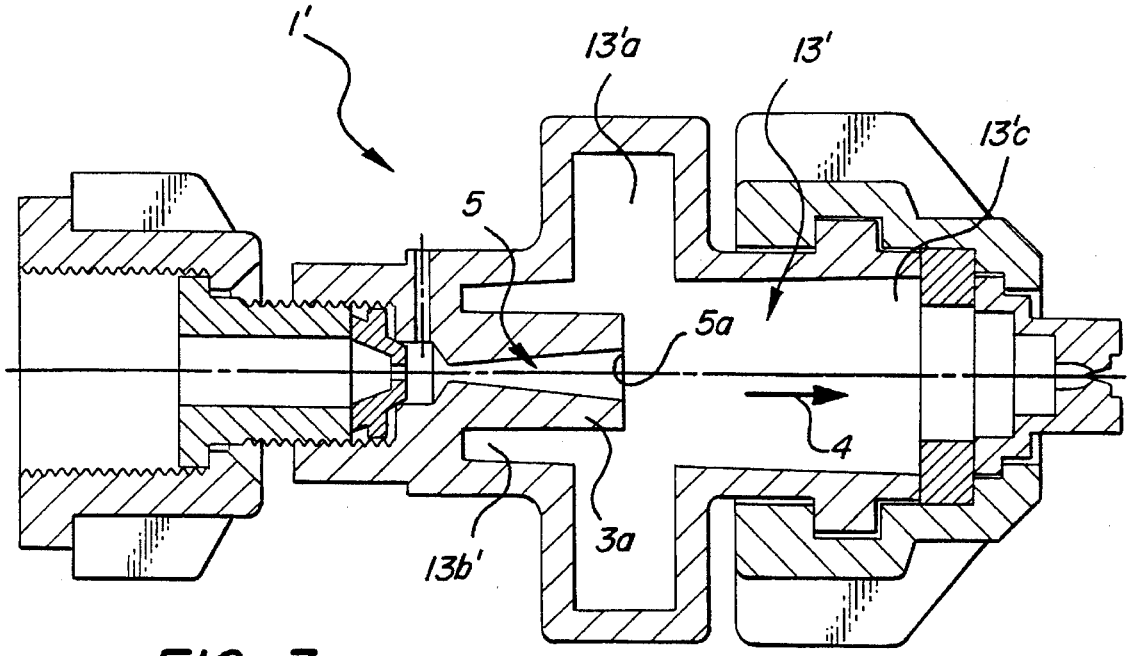
FIGS. 3 to 7 show similar axial longitudinal sections to FIG. 1, but in order to explain some further embodiments, particularly in the region of the homogenizing and stabilizing chamber.

In the example of FIG. 3, within the injector nozzle 1' the homogenizing and stabilizing chamber 13' is constructed with a particularly large volume and thus with a region 13'*a* which has a greater diameter than the other regions of this homogenizing and stabilizing chamber 13'. This region 13'*a* of greater diameter is provided for instance in the longitudinal portion of the homogenizing and stabilizing chamber 13' which surrounds the outlet cross-section 5*a* of the mixing chamber 5, so that here a particularly large inlet cross-section of the homogenizing and stabilizing chamber 13' is available by comparison with the outlet cross-section 5*a* of the mixing chamber 5. Also in this case the rear region 13*b'* of this homogenizing and stabilizing chamber can in annular form surround the component 3*a* forming the mixing chamber 5. At least the front region 13'*c* of the chamber 13' can also be slightly widened conically in the flow direction (arrow 4) of the jet of liquid.

Figure 4:
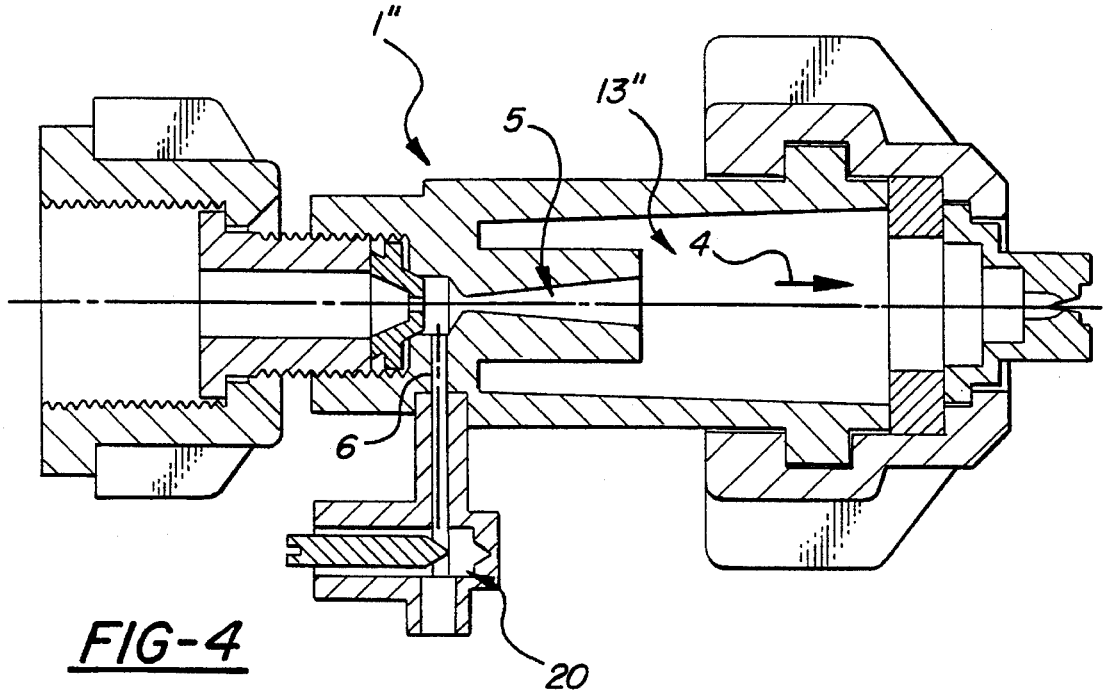

In FIG. 4 an embodiment of the injector nozzle 1" is illustrated in which the homogenizing and stabilizing chamber 13" can be constructed in a similar way to the homogenizing and stabilizing chamber 13' according to FIG. 3, with the exception that here (FIG. 4) there is no region with an enlarged diameter. Instead the homogenizing and stabilizing chamber 13" according to FIG. 4 is slightly widened conically over its entire length in the flow direct ion (arrow 4).

Figure 5:
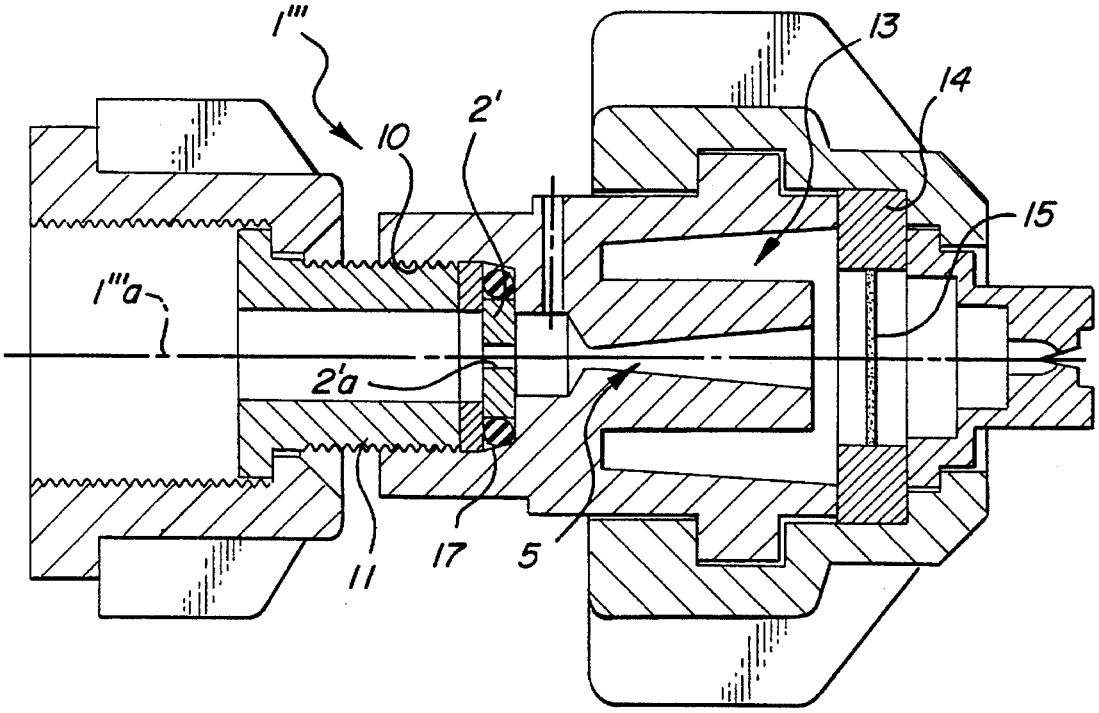
Figure 6:
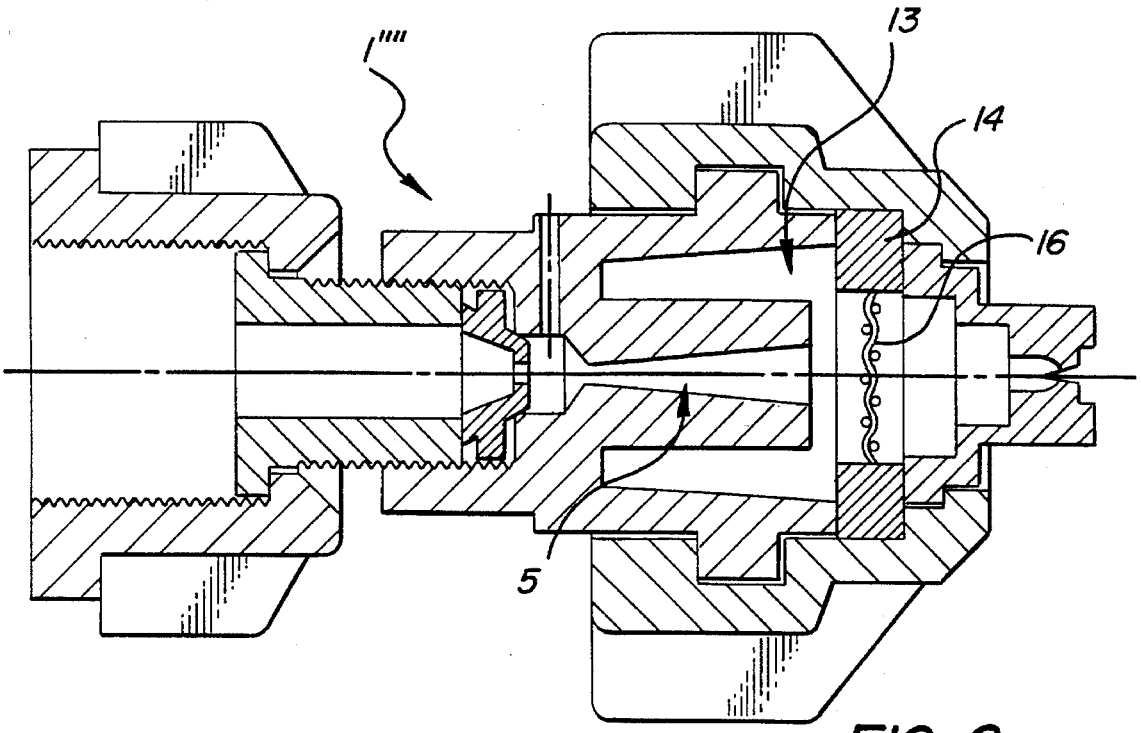

According to the embodiments of the injector nozzle 1''' and 1'''' in FIGS. 5 and 6 the homogenizing and stabilizing chamber 13 constructed therein can in each case be constructed and arranged in the same way as has been explained in detail with the aid of FIG. 1. One special feature of these two embodiments is that in each case a perforated element is also provided between the mixing chamber 5 and the distributor mouthpiece 7. This perforated element can be formed in the case of FIG. 5 by a punched plate 15 and in the case of FIG. 6 by a wire mesh or screen 16. In both embodiments this perforated element 15 or 16 respectively is built into the annular sealing member 14. In an optimal manner this perforated element 15 or 16 ensures an extremely good uniformity of the sizes of the drops of liquid.

By contrast with the embodiment described and illustrated with the aid of Figure, the embodiment of the injector nozzle 1''' in FIG. 5 has a further special feature, in that there the dosaging nozzle element 2', which is again disposed replaceably in the threaded bore 10 and fixed by the threaded adapter 11, can be constructed essentially in the form of a nozzle plate surrounded by an O ring 17 which can be made from a resilient sealing material and aligns this dosaging nozzle element 2' with its nozzle orifice **2'*a* coaxially with the longitudinal axis 1'''*a*** of the nozzle, so that here too a type of self-centering can be achieved.

Figure 7:
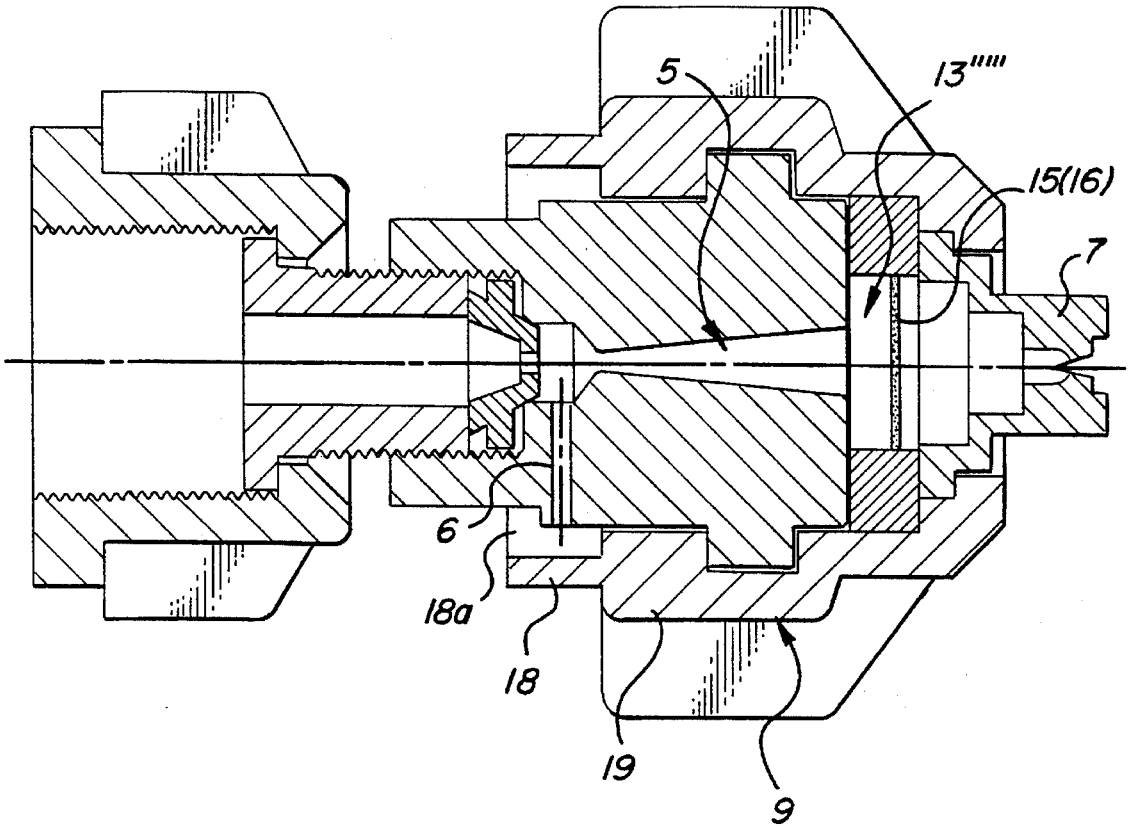

In FIG. 7 an embodiment of the injector nozzle is shown in which the homogenizing and stabilizing chamber 13'''' between the mixing chamber 5 and the distributor mouthpiece 7 can be kept particularly small, but also is greatly enlarged relative to the outlet cross-section of the mixing chamber 5. In this case too it may again be assumed that between the mixing chamber 5 and the distributor mouthpiece 7 there is provided a perforated element (preferably a wire mesh 16 or punched plate 15) which—as in FIGS. 5 and 6—can be built into the annular sealing member 14. The advantages of the injector nozzle according to the invention can also be achieved with this embodiment, and in this case a particularly compact and space-saving construction is also provided.

In the embodiment of the injector nozzle according to FIG. 7 a further special feature should be mentioned. According to this the air intake opening 6 can also be protected by a cover 18 which preferably—as shown in FIG. 7—is constructed in the form of an annular plate which covers a type of annular chamber or annular gap **18*a* and can be integrated in an axial extension of the socket-like fixing part 19 of the bayonet closure 9 or in the case of another construction of the rapid closure system for the distributor mouthpiece 7 it can also be integrated in a lock nut or connecting nut. Any liquid particles flowing back can be collected on such a cover 18 of the air intake opening 6** so that a separate non-return valve with the associated operational disadvantages can be avoided there in a simple manner.

With regard to the structural design in the region of the air intake opening 6 reference may again be made to the embodiment illustrated with the aid of FIG. 4. An additional possibility is given there of how the air intake opening 6 of the mixing chamber 5 can be connected to an arrangement, preferably to a throttle device 20, for altering the quantity of air drawn in. This throttle device which is shown at 20 can naturally also be formed by any other suitable arrangement which permits a corresponding alteration or control of the quantity of air to be drawn in.

In relation to these possible constructions in the region of the air intake opening 6 which have explained above with the aid of FIGS. 7 and 4 it may be explicitly emphasized that these possible constructions are associated not only with the embodiments of the injector nozzle explained with the aid of FIGS. 7 and 4 with the special forms of the homogenizing and stabilizing chamber, but that they can also be combined with all other described embodiments of the injector nozzle according to the invention.

Figure 8:
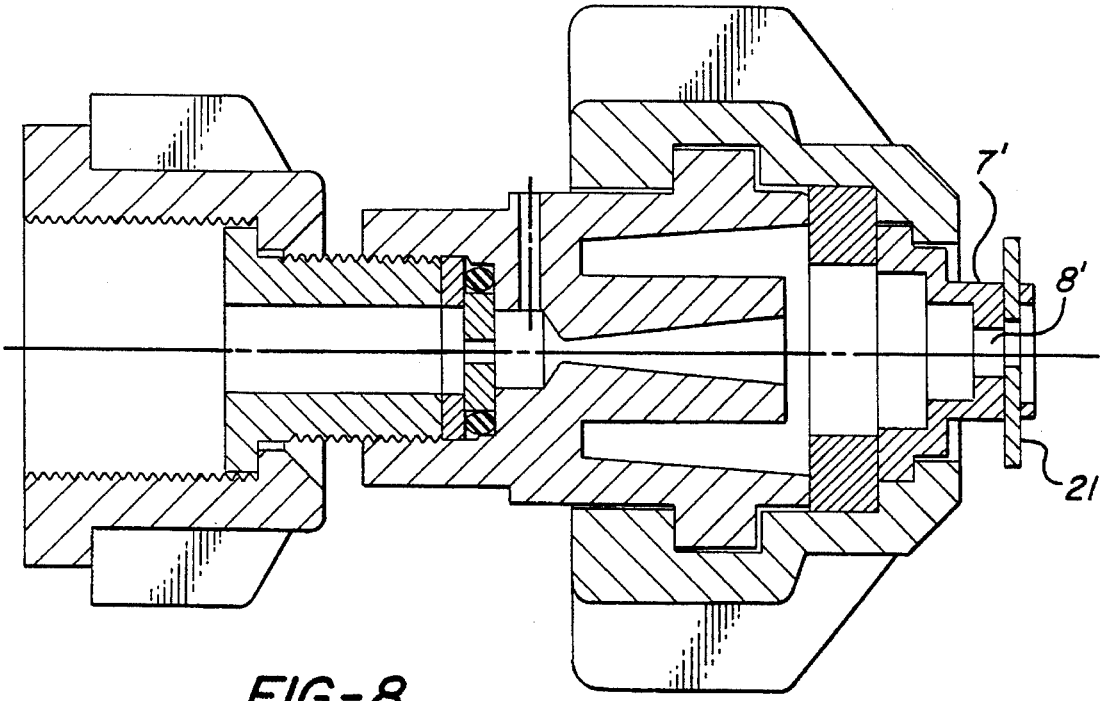
FIGS. 8 and 9 show similar axial longitudinal sections to FIG. 1, but in order to explain some variants of the construction of the outlet element.
Figure 9:
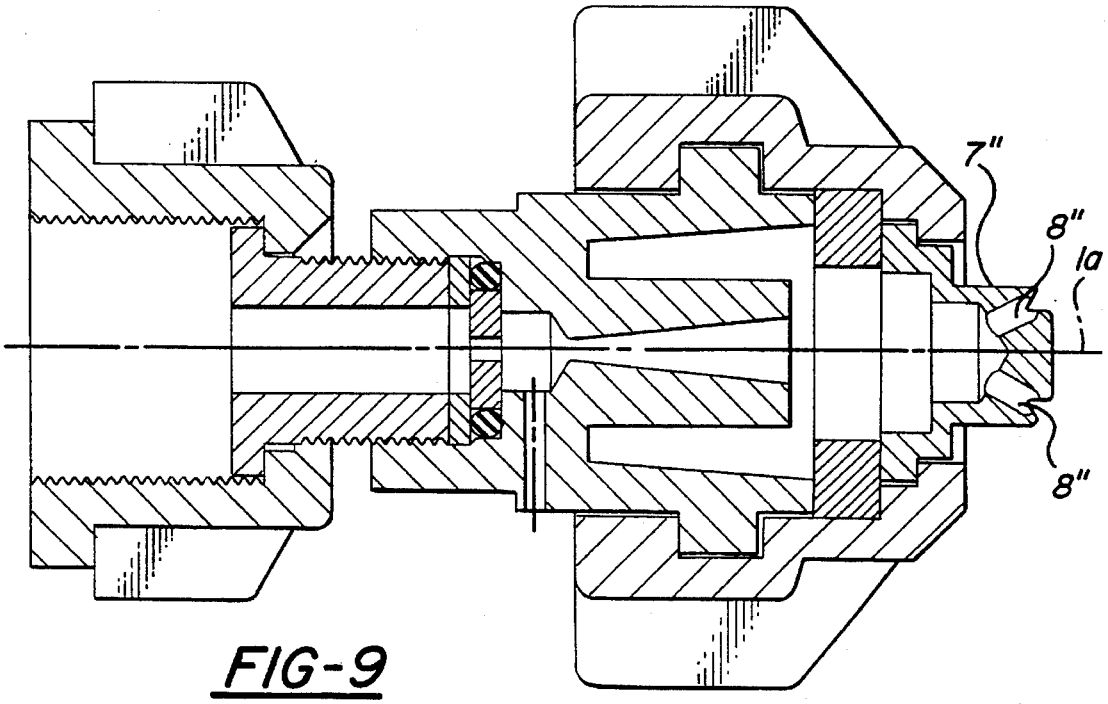

Finally, some further possibilities for the construction of the outlet element constructed as a distributor mouthpiece are illustrated with the aid of FIGS. 8 and 9.

FIG. 8 shows an embodiment of the distributor mouthpiece 7' with one single outlet opening 8' which has a cross-section which can be adjusted as regards shape and size. The latter can be achieved in that a perforated adjusting plate 21 can be provided like an adjusting plate approximately in the region before this outlet orifice 8' and can either be turned or moved transversely or radially in order to adjust the nozzle outlet opening 8' or the cross-section thereof in the desired manner.

FIG. 9 shows an embodiment in which the outlet element which is again constructed as a distributor mouthpiece 7" has several outlet orifices 8" which can be aligned so that with respect to the longitudinal axis la of the nozzle they diverge outwards relative to one another.

Also with regard to these possible constructions illustrated with the aid of FIGS. 8 and 9 for the nozzle outlet orifice or orifices 8' or 8" it may be emphasised that these constructions of the distributor mouthpiece 7' or 7" can be combined with all other previously described embodiments of the injector nozzle according to the invention.

I claim:

1. An injector nozzle construction for producing air-filled drops of liquid comprising:

a dosaging nozzle element having a nozzle orifice aligned coaxially with a central longitudinal axis of said nozzle construction for producing a jet of liquid in a downstream direction along said axis;

a mixing chamber arranged immediately downstream of said dosaging nozzle element having a fluid inlet aligned coaxially with said nozzle orifice for receiving said liquid, at least one air intake opening for introducing air into said chamber to produce a liquid/air mixture, and an outlet of predetermined cross-sectional size for discharging said liquid/air mixture from said mixing chamber, said mixing chamber conically widening in a direction toward said outlet;

an outlet element having at least one outlet orifice spaced longitudinally downstream of said mixing chamber for expelling said liquid/air mixture; and a homogenizing and stabilizing chamber between said mixing chamber and said outlet element, said homogenizing and stabilizing chamber having an inlet communicating directly with said outlet of said mixing chamber and having a cross-sectional size substantially greater than said cross-sectional size of said mixing chamber outlet.

2. The injector nozzle construction of claim 1 wherein the size of said inlet of said homogenizing and stabilizing chamber is about 1.5 to 9 times greater than the size of said outlet of said mixing chamber.

3. The injector nozzle construction of claim 1 wherein the size of said inlet of said homogenizing and stabilizing chamber is about 3 to 5 times greater than the size of said outlet of said mixing chamber.

4. The injector nozzle construction of claim 1 wherein said mixing chamber has a predetermined length and said homogenizing and stabilizing chamber has a predetermined overall length which is relatively greater than the length of said mixing chamber.

5. The injector nozzle construction of claim 1 wherein said homogenizing and stabilizing chamber includes an annular rear portion encircling said mixing chamber.

6. The injector nozzle construction of claim 1 wherein said homogenizing and stabilizing chamber has a space that is relative greater in diameter than the remaining space of said homogenizing and stabilizing chamber.

7. The injector nozzle construction of claim 1 including a perforated element arranged between said mixing chamber and said outlet element.

8. The injector nozzle construction of claim 7 wherein said perforated element is selected from a group of elements consisting essentially of a wire mesh element and a punched plate element.

9. The injector nozzle construction of claim 1 wherein said outlet element constitutes a separable, replaceable component of said injector nozzle construction.

10. The injector nozzle construction of claim 1 including a bayonet closure mounting said outlet element securely but releasably in place on said injector nozzle construction.

11. The injector nozzle construction of claim 1 wherein said dosaging nozzle element constitutes a separable, replaceable component of said injector nozzle construction.

12. The injector nozzle construction of claim 1 wherein said dosaging nozzle element is self-centering with respect to said longitudinal axis.

13. The injector nozzle construction of claim 1 wherein said outlet element includes a plurality of said outlet orifices.

14. The injector nozzle construction of claim 1 wherein said at least one outlet orifice of said outlet element has an adjustable cross section.

15. The injector nozzle construction of claim 14 wherein said outlet element cross-section is adjustable in shape.

16. The injector nozzle construction of claim 14 wherein said outlet element cross-section is adjustable in size.

17. The injector nozzle construction of claim 1 including a throttle device associated with said air intake opening of said mixing chamber for controlling the quantity of air drawn into said mixing chamber.

18. The injector nozzle construction of claim 1 including a cover extending about said mixing chamber defining an annular gap closed in the downstream direction and open in the upstream direction for shielding said air intake opening of said mixing chamber.

19. The injector nozzle construction of claim 1 wherein said mixing chamber includes at least one additional intake opening.

* * * * *